US006624753B2

(12) United States Patent
Elston

(10) Patent No.: US 6,624,753 B2
(45) Date of Patent: Sep. 23, 2003

(54) ONE PIECE SNAP CLOSE ANTI-THEFT HANG TAG FOR MERCHANDISE

(75) Inventor: Stephen Elston, Ormond Beach, FL (US)

(73) Assignee: World Color, Inc., Ormond Beach, FL (US)

( * ) Notice: Subject to any disclaimer, the term of this patent is extended or adjusted under 35 U.S.C. 154(b) by 107 days.

(21) Appl. No.: 09/774,210

(22) Filed: Jan. 30, 2001

(65) Prior Publication Data

US 2003/0011475 A1 Jan. 16, 2003

(51) Int. Cl.[7] ..... G08B 13/14

(52) U.S. Cl. ..... 340/572.8; 340/572.9; 340/572.1; 340/568.1; 24/16 PB; 24/30.5 R; 24/30.5 P; 70/57.5; 292/318

(58) Field of Search ..... 340/572.8, 572.9, 340/572.1, 568.1; 24/16 PB, 30.5 R, 30.5 P; 70/57.5; 292/318

(56) References Cited

U.S. PATENT DOCUMENTS

| | | | | | |
|---|---|---|---|---|---|
| 1,866,461 | A | | 7/1932 | Goschnick | |
| 1,948,255 | A | | 2/1934 | Brooks | |
| 2,002,856 | A | | 5/1935 | Hope | |
| 3,352,040 | A | | 11/1967 | Javkin | |
| 3,708,835 | A | | 1/1973 | Bienz | |
| 4,441,233 | A | | 4/1984 | Swift | |
| 4,506,415 | A | | 3/1985 | Swift | |
| 5,428,871 | A | * | 7/1995 | Iosif | 24/30.5 R |
| 5,437,172 | A | | 8/1995 | Lamy | |
| 5,524,463 | A | | 6/1996 | Schenkel | |
| 5,568,951 | A | | 10/1996 | Morgan | |
| 5,945,909 | A | | 8/1999 | Kolton | |
| 5,949,336 | A | * | 9/1999 | Deschenes et al. | 340/572.8 |
| 5,969,613 | A | | 10/1999 | Yeager | |
| 6,157,302 | A | | 12/2000 | Kolton | |
| 6,188,320 | B1 | * | 2/2001 | Kolton et al. | 340/572.9 |

FOREIGN PATENT DOCUMENTS

| | | |
|---|---|---|
| CH | 587530 | 5/1977 |
| FR | 624782 | 7/1927 |
| GB | 775266 | 5/1957 |
| GB | 2 025 856 A | 1/1980 |

* cited by examiner

*Primary Examiner*—Daniel J. Wu
*Assistant Examiner*—Tai T. Nguyen
(74) *Attorney, Agent, or Firm*—Allen, Dyer, Doppelt, Milbrath & Gilchrist, P.A.

(57) ABSTRACT

A hang tag having a bifolding body, one part of which has a long tail, and one of the parts having a recess adapted to receive an electronic article surveillance (EAS) device. The EAS device is placed or secured in the recess, the tail is wrapped around a piece of merchandise, and the other end of the tail is affixed to one of the bifolding bodies, and then the bifold is snapped shut permanently. The tag is made out of a tough, minimal stretch plastic such as nylon or another polyamide, enabling the tag to be assembled onto the merchandise simply by looping and snapping, without any riveting or other joining required. Using a tough polymer, the snap fit can be designed to create a permanent attachment so that the tag would have to be cut off or destroyed to remove it.

10 Claims, 1 Drawing Sheet

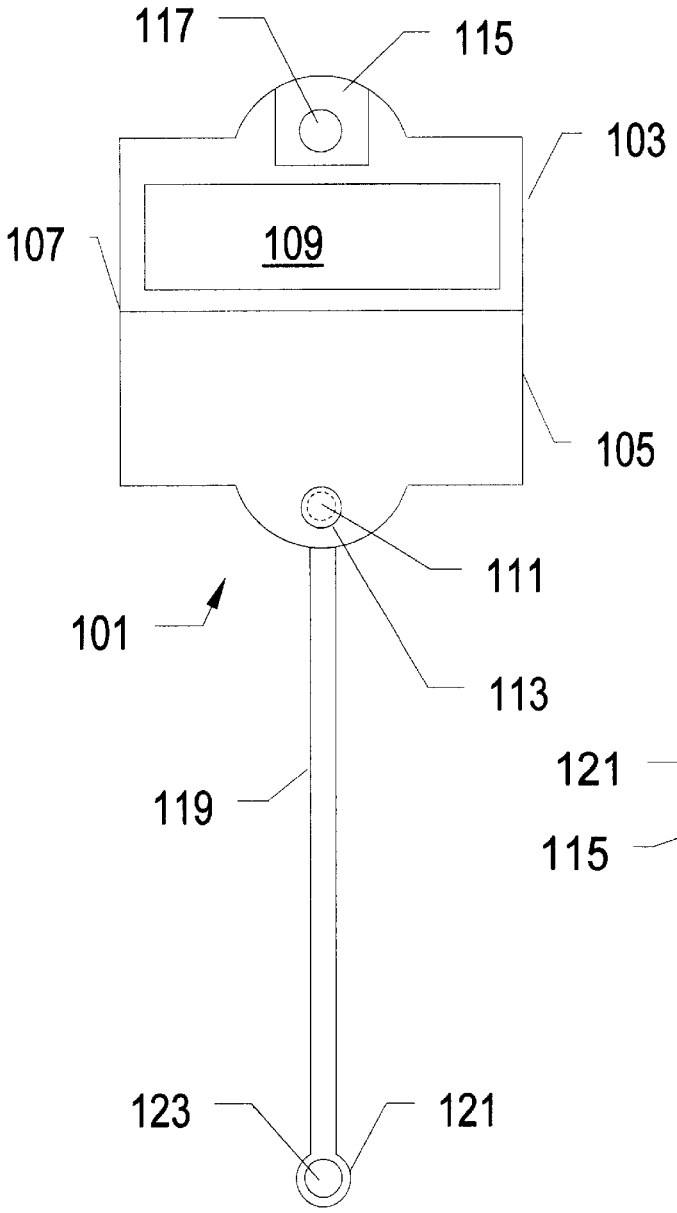
Fig. 1
Fig. 2
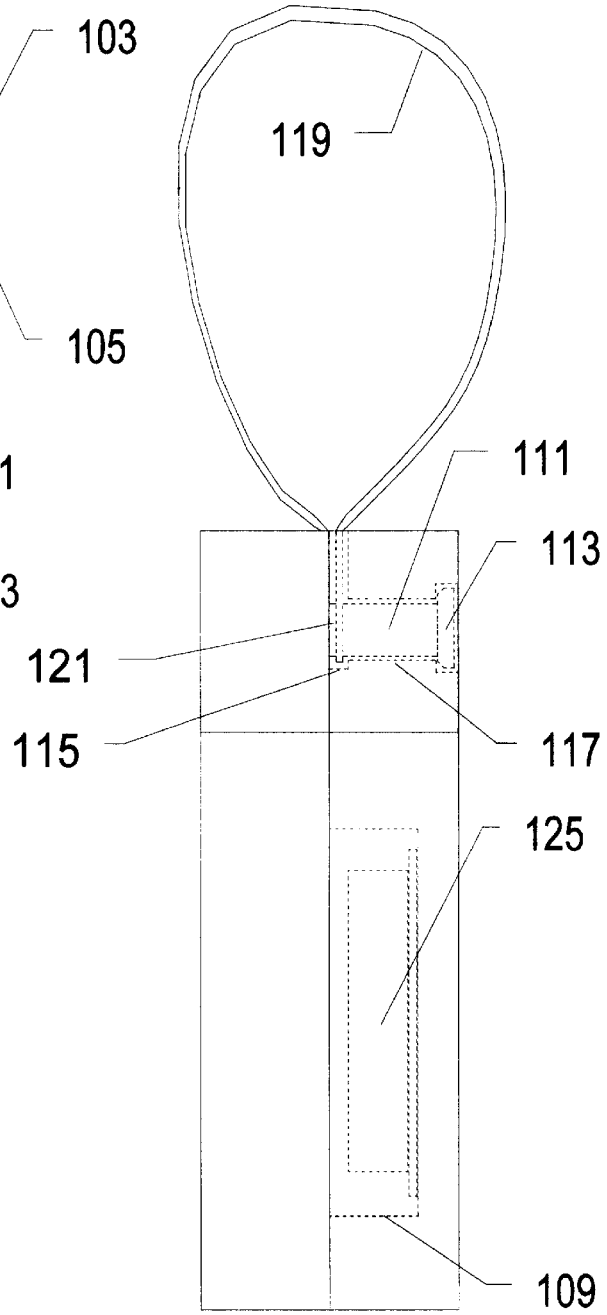

ONE PIECE SNAP CLOSE ANTI-THEFT HANG TAG FOR MERCHANDISE

BACKGROUND OF THE INVENTION

This invention relates to a hang tag housing an EAS device that is especially adapted to be attached especially to a pair of eyeglasses, and can be attached to any merchandise having a portion around which a tail or lead can be wrapped.

THE STATE OF THE ART

Antitheft tags for consumer articles are well-known, and systems using such device are referred to as electronic article surveillance (EAS) systems. Exemplary of EAS devices and systems using the same are U.S. Pat. Nos. 5,949,336 and 5,955,951, and the references cited there. In one embodiment, EAS tags have a circuit having a known resonant frequency and inducible to resonate by an externally applied magnetic or RF field, the existence of the expected resonance being evidence of the article; hence, placing such a device at the exit of an establishment indicates that an article of merchandise with such a tag is being taken from the store.

EAS devices and systems are well-known and do not form part of this invention. Rather, one aspect that retailers and manufacturers find is important is to keep the EAS tag as small and unobtrusive as possible. For example, a consumer looking at an article of clothing is less likely to purchase the article if it cannot be tried on because of the EAS tag, or because the article is fairly light (such as a shirt) but the EAS tag is oversized and too heavy to allow the clothing article to be tried on. As another example, attaching a conventional EAS tag to sunglasses, depending where on the spectacle frame the EAS tag is attached, typically renders the glasses almost impossible to wear, and thus a consumer is less likely to make the purchase because the article cannot be assessed properly or easily. Thus, for example, the above-noted Pat. No. 5,955,951 describes a relatively large EAS tag that is secured with a tack through clothing, and the U.S. Pat. No. 5,949,336 describes a less obtrusive device but one which looks like plastic tag of some sort. Yet another problem is that potential shoplifters may attempt to remove from the merchandise an EAS tag, or any tag (including, for example, a price tag) that is easily identifiable as such.

Various styles of hang tags have been developed over the years. One style is made of a molded plastic body having a tab molded to the body as a one piece unit, and where the body has a peg or similar device on which the tab can be secured after having been looped around the article to be sold. For large stores providing paper price or hang tags, a plastic loop having a flange or bulb at one end and a threadable eye at the other is known, where the bulb can be passed through and snap into the threadable eye, but cannot be pulled out without destroying the device. For the latter device, the plastic material used is a non-elastic, tough plastic, such as nylon.

Nevertheless, in light of the existing device, a simple hang tag housing an EAS device that can be permanently attached to an article is yet desired.

SUMMARY AND OBJECTS OF THE INVENTION

One object of the invention is to provide a one piece hang tag that can house an EAS device and be attached easily to an article of merchandise.

Another object of the invention is to provide a hang tag housing an EAS device wherein the hang tag can be securely closed by mechanical means; that is, without the use of heat sealing or adhesive.

It is a further object of the invention to provide such a device having an integral method for being attached to an article of merchandise.

These and other objects of the invention are provided by a device comprising a body able to be folded onto itself, the body having dual inner portions that meet when the body is folded onto itself, one of the dual inner portions having a recess therein adapted to receive an EAS device, one of the dual inner portions having a peg with a bulbous end and the other of the dual inner portions having a bore adapted to be snap-engaged by the bulbous end of the peg, the bore disposed in a second recess that extends to the margin of the inner portion, and a tail having two ends, one of which is attached to the body and the other of which has a loop adapted to permit the bulbous end of the peg to pass therethrough and having a size adapted to fit into said second recess.

BRIEF DESCRIPTION OF THE DRAWINGS

FIG. 1 is a plan view of one preferred embodiment of the present invention taking an open position thereof.

FIG. 2 is a side view of the embodiment of FIG. 1 illustrating a closed position thereof.

DETAILED DESCRIPTION OF SPECIFIC EMBODIMENTS

The device is generally shown in FIG. 1, in which the body 101 has dual inner portions 103 and 105 separated by a crease line 107 that functions as a hinge, allowing the body to be folded and the dual inner portions to face each other.

In one of the dual inner portions is a recess 109 adapted to receive an EAS device.

On one of the dual inner portions is a peg 111 having a larger free end 113 that is a flange or is bulbous. On the other inner portion is a second recess 115 having a bore 117 that is sized to allow a snap fit with the peg and flange.

On one of the portions of the body is a tail119 having at its free end a loop 121 with a bore 123 therein. The loop is sized to fit into the second recess 115, and the bore is sized to fit over the peg and flange.

The device is especially adapted for use with eyeglasses, sunglasses, and the like, although it can be used with any merchandise having a portion around which the tail can be wrapped with sufficient play to allow the bore in the loop to fit over the peg. Thus, for example, the tail can be put through a button eyelet in clothing, or around the frame of a tennis racquet, the handle of a bottle or an appliance (such as an iron) or an accessory (such as a pocket book or briefcase).

In use, an EAS device125 is secured into the recess. The tail is formed into a second loop and the bore in the loop at the free end of the tail is slipped over the flange onto the peg. Thereafter, the body is folded along the hinge and the flange on the peg is forced through the bore in the second recess, to form the configuration shown in FIG. 2 (absent the merchandise).

The EAS device can be secured by gluing or heat sealing; alternatively, it need not be secured and can be merely placed in the recess.

The device is preferably made of a tough plastic with low elasticity and deformity, which prevents the device from being opened after it has been snapped closed. Accordingly, preferred materials of construction include nylon and other polyamides, polystyrene and other vinyl polymers, polybutylene (but not polyethylene), and the like. Accordingly it is most preferred that the body and tail be integrally molded as a single piece. Of course, various colorants, fillers, mold release agents, and the like as are conventionally used can be added to the composition.

What is claimed is:

1. A hang tag comprising:

a body able to be folded onto itself, the body having dual inner portions that meet when the body is folded onto itself, one of the dual inner portions having a recess therein adapted to receive an EAS device, one of the dual inner portions having a peg with a bulbous end and the other of the dual inner portions having a bore adapted to be snap-engaged by the bulbous end of the peg, the bore disposed in a second recess that extends to the margin of the inner portion; and a tail having two ends, one of which is attached to the body and the other of which has a loop adapted to permit the bulbous end of the peg to pass therethrough and having a size adapted to fit into said second recess when said body is folded onto itself, the tail adapted to be wrapped around a portion of an article of merchandise.

2. The hang tag of claim 1, wherein the body and tail are molded as a single piece.

3. The hang tag of claim 2, wherein device is comprised of nylon.

4. The hang tag of claim 1, further comprising an EAS device in the recess.

5. The hang tag of claim 4, wherein the EAS device is secured in the recess by an adhesive.

6. A hang tag comprising:

a body having a first portion hingedly attached to a second portion for folding the first portion onto the second portion, the first and second inner portions each having an inner surface adapted for meeting when the body is in a folded position, at least one of the first and second portions having a recess therein adapted to receive an EAS device when the body is in the folded position;

a single peg having a bulbous end thereon carried by an inner surface of the first portion, an inner surface of the second portion having a bore therein for providing a snap-engagement by the bulbous end of the peg, and wherein the second portion includes a second recess having the bore therein, the second recess extending to the margin of the inner portion; and a tail having a first end attached to the body and an opposing second end having a loop therein adapted to permit the bulbous end of the peg to pass therethrough, the loop further having a size adapted to fit into the second recess when the first and second portions are folded onto themselves while maintaining a contacting of the first and second portion inner surfaces, the tail adapted to be wrapped around a portion of an article of merchandize.

7. The hang tag of claim 6, wherein the hingedly attached first and second portions are separated by a crease line formed within a material forming the body, the crease line extending attached along longitudinal edges for hingedly connecting the first and second portions.

8. The hang tag of claim 6, wherein the loop comprises a circular loop having a circular hole passing therethrough.

9. The hang tag of claim 6, further comprising an EAS device carried within the recess while the body is in the folded position.

10. The hang tag of claim 6, wherein the body and tail are molded as a single piece.

* * * * *